United States Patent [19]

Riggs

[11] Patent Number: 4,794,990

[45] Date of Patent: Jan. 3, 1989

[54] CORROSION PROTECTED SHAPED CHARGE AND METHOD

[75] Inventor: Robert S. Riggs, Grand Prairie, Tex.

[73] Assignee: Jet Research Center, Inc., Arlington, Tex.

[21] Appl. No.: 787

[22] Filed: Jan. 6, 1987

[51] Int. Cl.[4] ..... E21B 41/02; E21B 43/16

[52] U.S. Cl. ..... 166/902; 175/4.6; 102/306

[58] Field of Search ..... 166/902, 297, 55, 55.1; 175/3.5, 4.6; 102/306, 307, 476, 309; 106/14.22; 428/570, 546, 551; 427/216; 149/44, 14; 89/1.15

[56] References Cited

U.S. PATENT DOCUMENTS

| | | | |
|---|---|---|---|
| Re. 31,420 | 10/1983 | Christopher . | |
| 2,357,407 | 9/1944 | Kurtz | 18/55 |
| 2,611,711 | 9/1952 | Costello | 106/14.22 |
| 2,785,631 | 3/1957 | Blanchard | 102/20 |
| 2,930,708 | 3/1960 | Chatfield | 106/14.22 |
| 2,980,017 | 4/1961 | Castel | 102/20 |
| 3,034,178 | 5/1962 | Cartier et al. | 18/59.3 |
| 3,077,834 | 2/1963 | Caldwell | 102/24 |
| 3,079,863 | 3/1963 | Sutliff | 103/46 |
| 3,121,389 | 2/1964 | Delacour | 102/20 |
| 3,255,659 | 6/1966 | Venghiattis | 102/306 |
| 3,276,369 | 10/1966 | Bell | 175/4.6 |
| 3,282,354 | 11/1966 | Hakala et al. | 175/4.6 |
| 3,566,442 | 3/1971 | Hakala | 18/16 |
| 3,811,877 | 5/1974 | Hakka | 75/208 R |
| 3,951,218 | 4/1976 | Sjogren | 175/4.6 |
| 4,191,265 | 3/1980 | Bosse-Platiere | 175/4.6 |

*Primary Examiner*—Bruce M. Kisliuk

*Attorney, Agent, or Firm*—Mark E. McBurney; C. Clark Dougherty

[57] ABSTRACT

An improved shaped charge comprised of a bell-shaped casing, a shaped explosive material disposed within the casing having a cavity formed therein and a liner disposed within the cavity formed of compressed powdered metal is provided. The compressed powdered metal liner includes a coating of an unsaturated organic compound or mixture of such organic compounds thereon whereby the liner is protected from corrosion attack without adversely affecting the performance of the shaped charge. A method of preventing the corrosion of the compressed powdered metal liner of a shaped charge is also provided.

17 Claims, 1 Drawing Sheet

CORROSION PROTECTED SHAPED CHARGE AND METHOD

BACKGROUND OF THE INVENTION

1. Field of the Invention

The present invention relates to an improved corrosion protected shaped charge, and more particularly, to such a charge which includes a compressed powdered metal liner.

2. Description of the Prior Art

Shaped charges have been utilized in a variety of applications where a substantially unidirectional explosive jet is required. A principal such use is in the perforation of oil and gas wells. Generally, a shaped charge includes a bell-shaped casing, a shaped explosive material disposed within the casing having a cavity formed therein and a liner disposed within the cavity.

In the perforation of oil and gas wells, a plurality of shaped charges are located in the tubular housing of a perforating gun adapted to be lowered in a well bore. The tubular housing includes a plurality of ports formed therein, and each of the shaped charges is positioned in alignment with one of the ports whereby upon detonation of the shaped charges, explosive jets are formed which are directed through the ports. When the perforating gun is positioned within a well bore, the jets contact adjacent metal casing, cement or other material and form perforations therein which extend into one or more subterranean formations penetrated by the well bore.

The liners of heretofore used shaped charges have been formed of various materials. Recently, shaped charges used in perforating guns have included compressed powdered metal liners. Such liners disintegrate upon detonation of the explosive material of the shaped charges and avoid the formation of metal fragments or slugs as is the case when solid metal liners are utilized.

While powdered metal liners have been utilized successfully, they are extremely susceptible to oxidation and other forms of corrosion unless protected therefrom. Heretofore, corrosion protection of compressed powdered metal liners has been achieved by applying a coating of one or more saturated hydrocarbons to the surfaces of the liner. However, it has been found that the saturated hydrocarbon coating adversely affects the performance of the shaped charges in perforating applications, e.g., the depths of the perforations produced are reduced thereby.

By the present invention an improved corrosion protected shaped charge having a compressed powdered metal liner is provided as well as a method of preventing the corrosion of such powdered metal liners.

SUMMARY OF THE INVENTION

An improved shaped charge is provided comprised of a bell-shaped casing, a shaped explosive material disposed within the casing having a cavity formed therein and a liner disposed within the cavity formed of compressed powdered metal. A coating of an unsaturated organic compound or mixture of such compounds, i.e., one or more organic compounds having at least one double bond, at least one triple bond, or both double and triple bonds, is included on the compressed powdered metal liner. Such coating cases the liner to be protected from corrosion attack without adversely affecting the performance of the shaped charge.

Preferred organic compounds for use in accordance with this invention are open end hydrocarbons containing double and/or triple bonds, i.e., alkenes, alkynes, and/or alkenynes.

The corrosion protected shaped charge of the present invention is particularly suitable for use in an oil or gas well perforating gun in that upon detonation of the shaped charge, the powdered metal liner disintegrates and large fragments or slugs of the liner which could plug the formed perforations are not produced.

A method of preventing the corrosion of the liner of a shaped charge comprised of a bell-shaped casing, an explosive material disposed within the casing having a cavity formed therein and a compressed powdered metal liner disposed within the cavity is also provided. The method is comprised of coating the compressed powdered metal liner with an organic compound or mixture of organic compounds of the type described above whereby the liner is protected from corrosion attack, but the performance of the shaped charge is not adversely affected.

Other and further objects, features and advantages of the present invention will be readily apparent to those skilled in the art upon a reading of the description of preferred embodiments which follows when taken in conjunction with the accompanying drawing.

DESCRIPTION OF PREFERRED EMBODIMENTS

Figure 1:
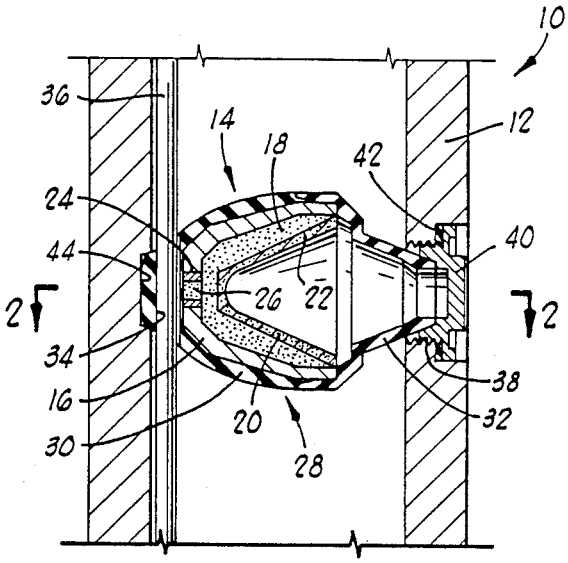
FIG. 1 is a partial vertical cross-sectional view of a shaped charge disposed in the tubular housing of an oil and gas well perforating gun.
Figure 2:
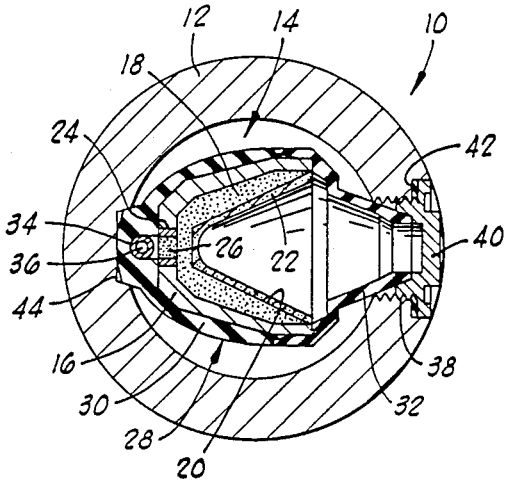
FIG. 2 is a cross-sectional view taken along line 2—2 of FIG. 1.

Referring now to the drawings, and particularly to FIGS. 1 and 2, a portion of a typical reusable perforating gun 10 is shown in cross section. The perforating gun 10 includes a hollow tubular housing 12 having a plurality of shaped charges 14 (only one shown) disposed therein in a desired orientation, one above the other.

Each shaped charge 14 is comprised of a bell-shaped casing 16, an explosive material 18 disposed within the casing having a cavity 20 formed therein and a liner 22 disposed within the cavity formed of compressed powdered metal. The cavity 20 in the explosive material 18 and the powdered metal liner 22 are preferably cone-shaped.

An opening 24 is provided through the rearward end of the casing 16 opposite the apex of the liner 22. Located within the opening 24 is a booster charge 26 for detonating the explosive material 18. The assembly of the casing 16, explosive material 18 and liner 22 is covered with a rubber covering 28. The rubber covering 28 is preferably cemented to the casing 16 and includes a rearward portion 30 and a forward portion 32. The forward portion 32 provides the desired standoff for the shaped charge assembly and helps maintain the assembly within the housing 12. The rearward portion 30 of the rubber covering 28 includes an opening 34 disposed through a thickened rear portion thereof. The opening 34 is positioned at right angles to the axis of the casing 16 and exposes the rearward end of the booster charge 26. A detonating cord 36 extends through the opening 34 and through other shaped charges in the housing 12.

A threaded port 38 is provided in the housing 12 adjacent the forward end of the shaped charge 14. The port 38 is sealed by a threaded port plug 40, and a sealing washer 42 is located between the port plug 40 and the housing 12. A recess 44 is disposed in the interior of the housing 12 at a position opposite from the port 38. The thickened rear part of the portion 30 of the rubber covering 28 extends into the recess 34. The forward portion 32 of the rubber covering 28 extends into the port 38 and a recess in the port plug 40 whereby the shaped charge 14 is rigidly held in the desired position within the housing 12.

In operation of the perforating gun 10, the detonating cord 36 is detonated by a suitable detonation initiating device. The detonation of the detonating cord detonates the booster charge 26 of the shaped charge 14 and other shaped charges within the tubular housing 12 which in turn brings about the detonation of the explosive material 18. The detonation of the explosive material 18 produces an explosive jet of hot gases which disintegrates the compressed powdered metal liner 22 and destroys the port plug 40. The jet extends through the port 38 and penetrates materials outside and adjacent the perforating gun 10.

The perforating gun 10 is utilized in a well bore penetrating one or more subterranean formations to perforate steel casing cemented therein and provide communication between the formation and the well bore. That is, the operation of the perforating gun 10 brings about the production of perforations extending through the casing and cement into a subterranean formation.

Figure 3:
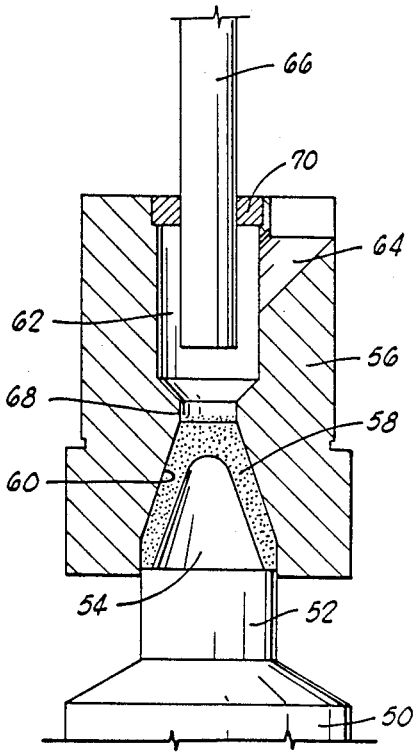
FIG. 3 is a side elevational view of apparatus for compressing powdered metal and forming a shaped charge liner therefrom with the apparatus in the loading position.
Figure 4:
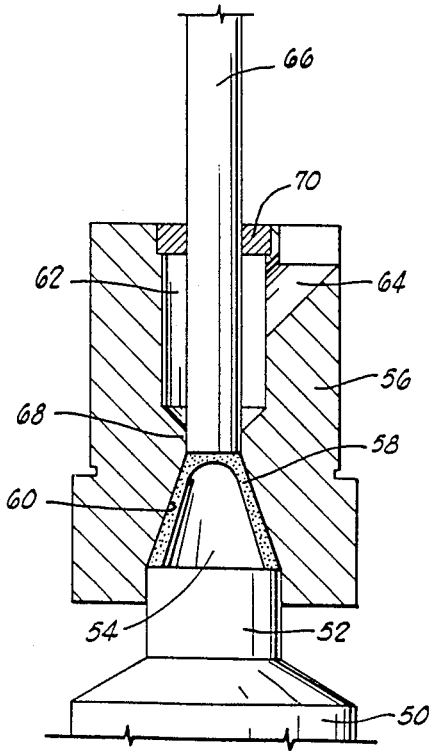
FIG. 4 is a view similar to FIG. 3 but showing the apparatus in the fully compressed position.

Illustrated in FIGS. 3 and 4 is an apparatus which can be used for compressing powdered metal and forming the liner 22. The apparatus is shown in FIG. 3 in the loading position, and includes an anvil 50 having a pedestal 52 upon which is mounted an interior mold 54. The interior mold 54 is of the shape of the interior surface of a finished liner 22. Positioned over the interior mold 54 is a mold housing 56 having an interior mold chamber 58 surrounding the interior mold 54. The walls 60 of the interior mold chamber 58 have the shape of the outer walls of a liner formed thereby.

The pedestal 52 of the anvil 50 is fitted into the mold chamber 58 of the mold housing 56, and slidable movement is allowed therebetween. A loading chamber 62 is provided in the upper portion of the mold housing 56, and a loading port 64 is provided which communicates with the loading chamber 62. The loading port 64 is used for loading powdered metal into the loading chamber 62. A plunger 66 is centered in the loading chamber 62 and is arranged such that when lowered into a necked down portion 68 of the housing 56, a seal is provided between the loading chamber 62 and the mold chamber 58. A centering and sealing means 70 is provided in the upper end of the mold housing 56 to center plunger 66 in the loading chamber 62.

In operation, powdered metal is introduced into the loading chamber 62 by way of the loading port 64. The powdered metal flows through the necked down portion 68 and into the mold chamber 58. When the mold chamber 58 is filled with powdered metal, the plunger 66 is lowered to seal the necked down portion 68, and the plunger 66 and mold housing 56 are simultaneously lowered as shown in FIG. 4. That is, the plunger 66 and mold housing 56 are moved downwardly on the pedestal 52 whereby the powdered metal in the mold chamber 58 is compressed and a compressed powdered metal liner formed therein.

The powdered metal mixture utilized for forming liners is preferably of approximately 100 micron average diameter and is comprised of about 80% by weight iron or copper, 19% by weight lead or tin and 1% by weight graphite. Preferably, the powdered metal mixture is comprised of copper, lead and graphite in the amounts set forth above, although mixtures including tungsten and antimony with the basic copper have also been used.

As mentioned above, the use of liners formed of compressed powdered metal in perforating gun shaped charges is beneficial in that upon detonation of the explosive materials in the shaped charges, the powdered metal liners are disintegrated. Thus, metal fragments or slugs which culd plug the perforations produced are not formed. However, a disadvantage in the use of such powdered metal liners is their extreme susceptibility to oxidation and other forms of corrosion due to their high surface area exposure. By the present invention, the liners are protected from corrosion without adversely affecting the performance of shaped charges assembled therewith by coating the liners with an unsaturated organic compound or mixture of unsaturated organic compounds, i.e., one or more organic compounds having at least one double bond, e.g., alkenes; at least one triple bond, e.g., alkynes; and/or both double and triple bonds, e.g., alkenynes.

Suitable unsaturated compounds for use in accordance with this invention are comprised of organic materials which are known to contain in their structure at least two adjacent carbon atoms bonded covalently by two $SP^2$ electrons and two Pi bond electrons, producing what is commonly known as a carbon-carbon double bond; the aliphatic carbon atoms may be bonded by two SP electrons and four Pi bond electrons resulting in a carbon-carbon triple bond. The preferred compounds are liquid at room temperature so as to provide for ease of application (however, vapor phase or solid phase material can be utilized), and contain carbon atoms in the range of from about 5 to about 60 carbon atoms per molecule. Particularly suitable such unsaturated compounds are those selected from the group consisting of isoprene, decyne, ocimene and squalene. Particularly suitable mixtures are the naturally occurring unsaturated oils such as linseed oil and tung oil.

The corrosion protecting coating of the unsaturated compound or mixture of unsaturated compounds used can be applied to a compressed powdered metal liner after the liner is formed by immersing the liner in the compounds, spraying the compounds on the liner or other similar technique. The liner is then allowed to cure at room temperature for a period of time whereby the compounds polymerize, gel or otherwise solidify on the liner.

In an alternate technique, the unsaturated compound or compounds utilized can be mixed with the powdered metal used to form the liner prior to compressing the powdered metal and forming the liner followed by room temperature curing. Preferably, the unsaturated compound or mixture of compounds is combined with the powdered metal in an amount in the range of from about 0.001% to about 1% by weight of the resulting powdered metal-hydrocarbon mixture. The mixture is then compressed in the forming apparatus described above or other similar apparatus to form the compressed powdered metal liner.

A particularly suitable powdered metal-alkene hydrocarbon mix is comprised of copper, lead and boiled linseed oil wherein powdered copper is present in an amount in the range of from about 50% to about 90% by weight of the powdered metal mixture without hydrocarbon, and boiled linseed oil is present in an amount of about 1% by weight of the resulting powdered metal-hydrocarbon mixture.

In order to further illustrate the present invention, the following example is given.

EXAMPLE

Compressed powdered metal liners formed of 80% by weight copper, 19% by weight lead and 1% by weight graphite are formed and used in the assembly of a plurality of shaped charges containing one gram of RDX booster charge and 31.4 grams of phlegmatized main charge. A portion of the compressed powdered metal liners formed do not include any corrosion protection. Another portion of the liners are corrosion protected by mixing linseed oil with the powdered metal mixture prior to compression in the amount of about 0.1% by weight of the resulting powdered metal-oil mixture. The remaining portion of liners are corrosion protected by mixing mineral oil with the powdered metal mixture prior to compression in the amount of about 0.1% by weight of the resulting powdered metal-oil mixture.

The effectiveness of the assembled shaped charges described above are tested by firing the charges into a ⅛" steel plate spaced above a ⅜" steel plate which is in turn seated on a concrete cylinder. The ⅛" and ⅜" steel plates are spaced apart by a distance of 0.74 inch, and the space between the plates is filled with water. The standoff distance between each shaped charge tested and the ⅛" steel plate is 0.9 inch. The use of the two steel plates separated by water and concrete in the tests simulates the operation of a perforating gun in a well bore containing a cemented steel casing.

After each test shot, the penetration through the ⅜" steel plate and into the concrete cylinder is measured. 80 grams/foot detonating cord is utilized to initiate detonation of the shaped charge assemblies.

The results of these tests are given in Table I below.

TABLE I

| Liners with No Corrosion Protection | | Liners Coated with Unsaturated Hydrocarbons[1] | | Liners Coated with Saturated Hydrocarbons[2] | |
|---|---|---|---|---|---|
| Shot | Penetration, In. | Shot | Penetration, In. | Shot | Penetration, In. |
| 1 | 24.1 | 1 | 24.2 | 1 | 22.6 |
| 2 | 23.7 | 2 | 23.9 | 2 | 23.1 |
| 3 | 24.6 | 3 | 24.4 | 3 | 23.0 |
| AVERAGE: | 24.1 | | 24.2 | | 22.9 |

[1]0.1% by weight boiled linseed oil.
[2]0.1% by weight mineral oil.

From Table I it can be seen that shaped charges assembled with compressed powdered metal liners having coatings of unsaturated alkene hydrocarbons thereon (boiled linseed oil) achieve penetrations equivalent to shaped charges assembled with unprotected compressed powdered metal liners (no coating). The shaped charges assembled with compressed powdered metal liners coated with saturated hydrocarbons (mineral oil) do not function as well as the other shaped charges in that less penetration is achieved.

Thus, the present invention is well adapted to achieve the ends and advantages mentioned as well as those inherent therein. While numerous changes will suggest themselves to those skilled in the art, such changes are encompassed within the spirit of this invention as defined by the appended claims.

What is claimed is:

1. In a shaped charge comprised of a bell-shaped casing, an explosive material disposed within said casing having a cavity formed therein and a liner disposed within the cavity formed of compressed powdered metal, the improvement comprising including a coating of an unsaturated organic compound consisting essentially of linseed oil on said compressed powdered metal liner whereby said liner is protected from corrosion attack without adversely affecting the performance of said charge.

2. In a shaped charge comprised of a bell-shaped casing, an explosive material disposed within said casing having a cavity formed therein and a liner disposed within the cavity formed of compressed powdered metal, the improvement comprising said compressed powdered metal liner being formed of a mixture of copper and lead and including a coating of an unsaturated organic compound consisting essentially boiled linseed oil on said compressed powdered metal liner whereby said liner is protected by corrosion attack without adversely affecting the performance of said charge.

3. In a shaped charge comprised of a bell-shaped casing, an explosive material disposed within said casing having a cavity formed therein and a liner disposed within the cavity formed of compressed powdered metal, the improvement comprising including a coating of an unsaturated organic compound or mixture of such organic compounds on said compressed metal liner whereby said liner is protected from corrosion attack without adversely affecting the performance of said charge, said coating being applied to said powdered metal prior to when said powdered metal is compressed and said liner is formed therefrom.

4. In an oil and gas well perforating gun comprised of a tubular housing and a plurality of shaped charges disposed within the housing, each of the shaped charges including a bell-shaped casing and a compressed powdered metal liner disposed within the casing with explosive material therebetween, the improvement comprising each of said compressed powdered metal liners of said shaped charges including a coating of an unsaturated organic compound consisting essentially of linseed oil thereon whereby said liners are protected from corrosion attack without adversely affecting the performance of said shaped charges.

5. The perforating gun of claim 4 wherein said tubular housing includes a plurality of ports formed therein and each of said shaped charges is positioned in alignment with one of said ports whereby upon detonation of said charges, said compressed powdered metal liners are destroyed and jets are formed which are directed through said ports.

6. The perforating gun of claim 5 wherein each of said ports is sealed with a replaceable plug.

7. The perforating gun of claim 6 wherein said compressed powdered metal liners of said shaped charges are cone-shaped.

8. In an oil and gas well perforating gun comprised of a tubular housing and a plurality of shaped charges disposed within the housing, each of the shaped charges including a bell-shaped casing and a compressed powdered metal liner disposed within the casing with explosive material therebetween, the improvement comprising each of said compressed powdered metal liners of said shaped charges being comprised of a mixture of copper and lead and including a coating of an unsaturated organic compound consisting essentially boiled linseed oil thereon whereby said liners are protected from corrosion attack without adversely affecting the performance of said shaped charges.

9. In an oil and gas well perforating gun comprised of a tubular housing and a plurality of shaped charges disposed within the housing, each of the shaped charges including a bell-shaped casing and a compressed powdered metal liner disposed within the casing with explosive material therebetween, the improvement comprising each of said compressed powdered metal liners of said shaped charges including a coating of unsaturated organic compound or compounds thereon whereby said liners are protected from corrosion attack without adversely affecting the performance of said shaped charges, said coating being applied to said powdered metal prior to when said powdered metal is compressed and said liner is formed therefrom.

10. A method of preventing the corrosion of the liner of a shaped charge comprised of a bell-shaped casing, an explosive material disposed within the casing having a cavity formed therein and a compressed powdered metal liner disposed within the cavity comprising coating said compressed powdered metal liner with an unsaturated organic compound consisting essentially of linseed oil whereby said liner is protected from corrosion attack without adversely affecting the performance of said shaped charge.

11. The method of claim 10 wherein said compressed powdered metal liner is coated with said unsaturated organic compound by applying said compound to the surfaces of said liner.

12. A method of preventing the corrosion of the liner of a shaped charge comprised of a bell-shaped casing, an explosive material disposed within the casing having a cavity formed therein and a compressed powdered metal liner formed of a mixture of copper and lead disposed within the cavity comprising coating said compressed powdered metal liner with an unsaturated organic compound consisting essentially boiled linseed oil whereby said liner is protected from corrosion attack without adversely affecting the performance of said shaped charge.

13. A method of preventing the corrosion of the liner of a shaped charge comprised of a bell-shaped casing, an explosive material disposed within the casing having a cavity formed therein and a compressed powdered metal liner disposed within the cavity comprising coating said compressed powdered metal liner with an unsaturated organic compound or mixture of such compounds whereby said liner is protected from corrosion attack without adversely affecting the performance of said shaped charge, said compressed powdered metal liner being coated with said unsaturated organic compound or compounds by mixing said unsaturated compound or compounds with the powdered metal used to form said liner prior to compressing said powdered metal and forming said liner.

14. The method of claim 13 wherein said unsaturated organic compound of compounds are mixed with said powdered metal in an amount in the range of from about 0.001% to about 1% by weight of the resulting powdered metal-organic compound mixture.

15. The method of claim 13 wherein said powdered metal is comprised of a mixture of copper and lead and said unsaturated mixtured of organic compounds is boiled linseed oil.

16. The method of claim 15 wherein said mixture of powdered copper and lead contains copper in an amount in the range of from about 50% to about 90% by weight of said mixture.

17. The method of claim 16 wherein said mixture of unsaturated organic compounds is mixed with said mixture of powdered copper and lead in an amount of about 0.1% by weight of the resulting powdered metal-organic compound mixture.

* * * * *

UNITED STATES PATENT AND TRADEMARK OFFICE

CERTIFICATE OF CORRECTION

PATENT NO. : 4,794,990

DATED : January 3, 1989

INVENTOR(S) : Robert S. Riggs

It is certified that error appears in the above-identified patent and that said Letters Patent is hereby corrected as shown below:

In column 1, line 66 delete [cases] and insert therefore --causes--.

Signed and Sealed this

Sixth Day of June, 1989

*Attest:*

*Attesting Officer*

DONALD J. QUIGG

*Commissioner of Patents and Trademarks*